United States Patent [19]

Egli

[11] 4,117,649

[45] Oct. 3, 1978

[54] SYSTEM FOR FORMING, FILLING AND CLOSING BAGS

[75] Inventor: Alwin Egli, Beringen, Switzerland

[73] Assignee: Sig Schweizerische Industrie-Gesellschaft, Neuhausen am Rheinfall, Switzerland

[21] Appl. No.: 782,545

[22] Filed: Mar. 29, 1977

[30] Foreign Application Priority Data

Mar. 29, 1976 [CH] Switzerland ..... 3887/76

[51] Int. Cl.[2] ..... B65B 1/02; B65B 3/02

[52] U.S. Cl. ..... 53/558; 53/168; 53/250; 93/12 R; 93/35 SB

[58] Field of Search ..... 53/29, 168, 183, 187, 53/202, 266, 282, 250, 252, 186; 93/8 R, 12 R, 18, 20, 35 SB, 82

[56] References Cited

U.S. PATENT DOCUMENTS

| | | | |
|---|---|---|---|
| 2,045,230 | 6/1936 | Howard | 53/183 X |
| 2,770,935 | 11/1956 | Nigrelli | 53/168 |
| 3,855,907 | 12/1974 | Johnson et al. | 93/35 SB |
| 3,973,474 | 8/1976 | Auckenthaler | 93/12 R |

FOREIGN PATENT DOCUMENTS

| | | | |
|---|---|---|---|
| 2,453,201 | 5/1976 | Fed. Rep. of Germany | 53/183 |

*Primary Examiner*—Robert Louis Spruill
*Attorney, Agent, or Firm*—Spencer & Kaye

[57] ABSTRACT

In a system including a bag forming apparatus for forming a succession of bags, bag filling and closing apparatus, and a conveying apparatus for conveying each bag, after it is formed, along a conveying path from the bag forming apparatus to the filling and closing apparatus, the system production speed is increased by disposing the bag forming apparatus laterally to one side of the conveying path and associating the bag forming apparatus with a bag transporting member arranged to transport each bag, after it has been formed, into the conveying path, whereby the conveying apparatus can convey bags which were previously formed along the conveying path during at least a portion of the bag forming operating cycle of the bag forming apparatus.

1 Claim, 2 Drawing Figures

SYSTEM FOR FORMING, FILLING AND CLOSING BAGS

BACKGROUND OF THE INVENTION

The present invention relates to a system for forming, filling and closing bags, particularly of the type including at least one bag producing, or forming, device feeding a conveying apparatus which is provided with supporting members which transport the bags in stages to filling and closing means.

There presently exist systems of this type which have the drawback that they operate relatively slowly. The reason for this is, inter alia, that the conveying apparatus, into whose supporting members the bags being shaped are introduced in longitudinal direction, must be stopped until the bag forming apparatus has formed a new bag. Such apparatus may be constructed, for example, as disclosed in Swiss Pat. No. 542,701 and corresponding U.S. Pat. No. 3,774,509, or in Swiss Patent Application No. 11,183/75 and corresponding U.S. Application Ser. No. 719,057, filed on Aug. 30th, 1976.

SUMMARY OF THE INVENTION

It is a primary object of the present invention to eliminate this drawback.

A more specific object of the invention is to increase the rate at which bags can be processed in such a system.

A related object of the invention is to increase the degree of utilization of filling and closing machinery.

These and other objects are achieved, according to the invention, by disposing the bag forming apparatus laterally to one side of the conveying path defined by the conveying apparatus, and by associating with the bag forming apparatus a plunger which is movable back and forth in a direction perpendicular to the conveying direction and which, after the presentation of a bag by the bag forming apparatus, performs a back and forth movement and thereby inserts a bag into one of the supporting members of the laterally disposed conveying device so that the bags are transported along the conveying path during the manufacture of further bags.

The decoupling between bag formation and filling realized by the plunger makes it possible to better utilize the relatively great capacity of the conventional filling and closing apparatus than had previously been possible.

In further accordance with the invention, two or more bag producing apparatuses may be provided, each having a respective plunger, to feed an endless chain of support members which bring the bags to the thus more efficiently utilized filling and closing apparatuses.

DESCRIPTION OF THE PREFERRED EMBODIMENTS

Figure 1:
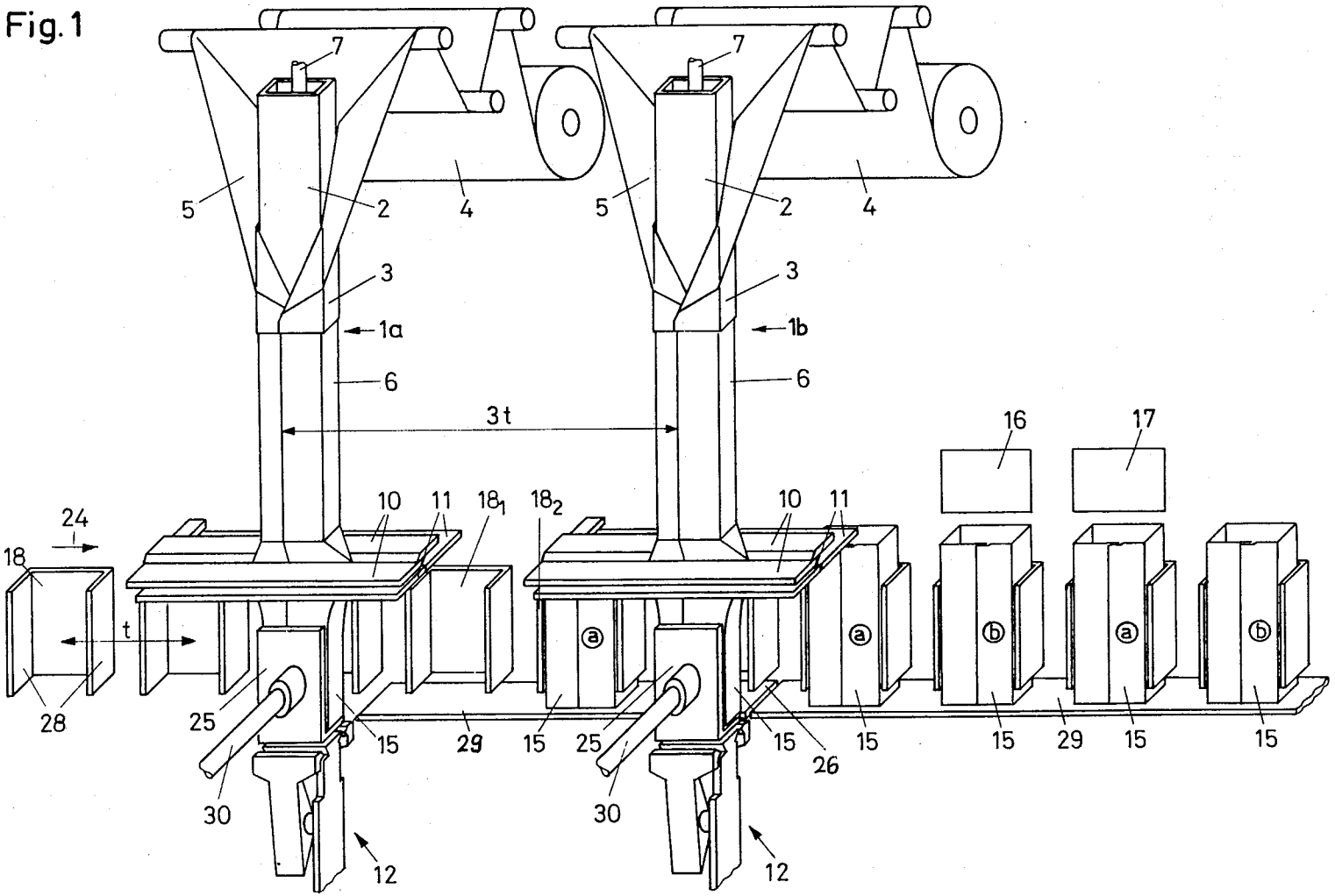
FIG. 1 is a perspective view of a system according to the invention including two bag forming apparatuses.
Figure 2:
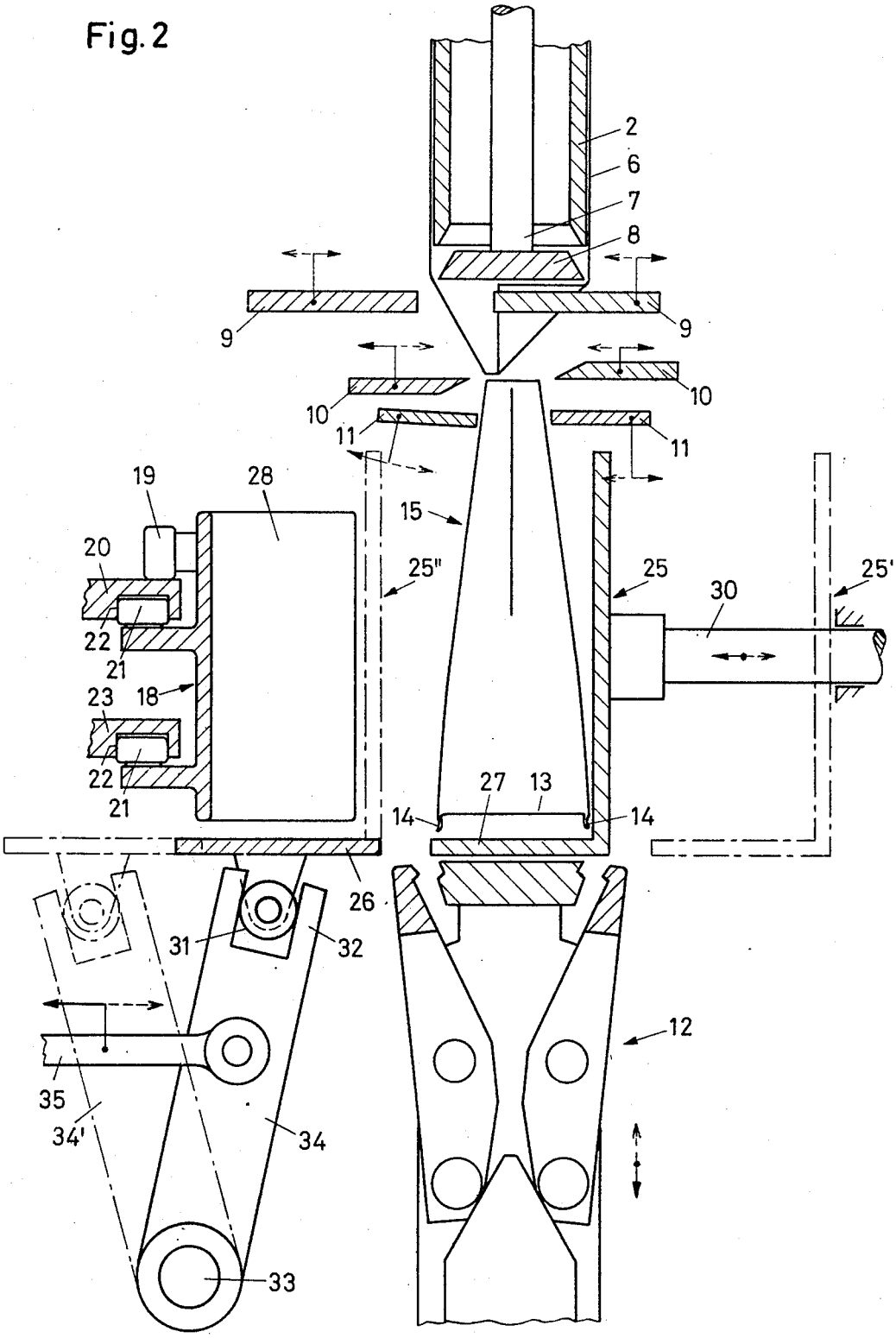
FIG. 2 is an elevational cross-sectional view through one of the bag forming apparatuses of FIG. 1, showing the essential components thereof.

The system illustrated in FIG. 1 includes two apparatuses 1a and 1b to produce bags of a foil-type material, e.g. paper or plastic. Each apparatus 1*a* or 1*b* includes a hollow mandrel 2 having a rectangular cross section, the mandrel being enclosed by a folding box 3. Between the hollow mandrel 2 and the folding box 3, a foil 5 which has been removed from a supply roll 4 is shaped into a tube 6. In the interior of the hollow mandrel 2 there is disposed the shaft 7 of a bottom ram 8, shown in FIG. 2, which shaft can be moved up and down and cooperates in a known manner, also as shown in FIG. 2, with two oppositely movable bottom folders 9 in order to form the bottom of a bag at the lower end of the tube 6.

Below the two bottom folders 9, two blades 10 movable in opposition to define a pair of scissors are provided, and below them there are two clamping jaws 11 which are pivotal and displaceable in translation, respectively. Movement of each of parts 9, 10 and 11 is in the direction of the arrows associated therewith in FIG. 2. If the packaging foil 5 consists of a weldable, or heat sealable, material, welding jaws (not shown) are provided, as shown, for example, in the above-cited patents. If the foil 5 is made of paper, well-known gluing agents are provided instead.

As shown in the above-cited patent applications, the bag forming apparatus further includes grippers 12 which are aligned with hollow mandrel 2 and by means of which the tube 6 is pulled downwardly in a predetermined phase of the process via two downwardly projecting folds 14 which have been formed at the lateral edges of the bottom 13 of the bag. Then a cut by means of blades 10 completes formation of a bag and clamping jaws 11 are opened. Bag 15 initially is at that time still slightly tapered toward the top but as soon as it is completely free of clamping jaws 11 it stands erect in the form of a rectangular prism.

Whereas in the bag producing device disclosed in the above-cited patents, grippers 12 pull bag 15 into a cardboard box which is disposed on a conveyor belt or the like, the present system is designed for producing bags which are not to be enclosed in further packaging. In order to further transport the bag 15 to a filling station 16 and from there to a closing station 17, the conveying apparatus is provided with a succession of supporting members 18 having a U-shaped horizontal cross section. The legs of such U are constituted by vertical front and rear walls 28 extending transverse to conveying direction 24. The supporting members are connected together by means of one or a plurality of chains (not shown) to form an endless carrying and supporting chain which is advanced in steps equal to the spacing of successive supporting members 18. As can be seen in FIG. 2, each supporting member is itself supported on a frame member 20 by means of a roller 19 and is guided by means of two rollers 21 which engage in grooves 22 in this frame member 20 and in a further frame member 23, respectively.

Supporting members 18, which move in the direction 24 in FIG. 1, are offset laterally from hollow mandrels 2 and grippers 12, this offset being toward the rear in FIG. 1.

In order to insert a bag 15 into a support member 18, each forming apparatus is provided with a plunger 25 having a horizontal arm 27 constituting a bag supporting surface and a vertical arm for retaining the bag on the plunger while the bag is being pushed into the conveying path. The horizontal and vertical arms are arranged to give plunger 25 an L-shaped cross section in a vertical plane transverse to conveying direction 24. Plunger 25 is attached to a shaft 30 movable back and forth in a direction perpendicular to the conveying direction 24.

During the up and down movement of grippers 12, plunger 25 is in its rest position 25' shown in dot-dash lines in FIG. 2. Immediately prior to the release of a newly formed bag 15 by clamping jaws 11, at which time the bag has already been cut off by blades 10, plunger 25 is advanced to a position below the bag so that it receives the latter. When plunger 25 continues to advance to the position 25" shown in dot-dash lines in FIG 2, it pushes bag 15 into supporting member 18.

During the conveying movement of the chain connecting together the supporting members, bag 15 slides on a bottom 29 which is fixed to the machine frame. In the region of each forming apparatus 1*a* and 1*b*, bottom 29 is provided with a break for the horizontal arm 27 of the associated plunger 25. The break in the region of apparatus 1*b* is periodically filled with the aid of a controlled movable bottom 26 which is moved into the position 26' shown in dot-dash lines in FIG. 2 in order to make room for the advancing horizontal arm 27 of plunger 25. The movable bottom 26 is provided with a roller 31 attached to its lower side and is slidably disposed on a straight guide which is not shown. The roller 31 is engaged in the forked end 32 of the lever 34 which is rotatably seated on the shaft 33. In order to pivot the lever 34 between the two end positions 34', 34 a pole 35 is provided which may be for example moved back and forth by gear means with curved discs (not shown). By pivoting the lever 34 the movable bottom is displaced in accordance with the plunger 25. During the return movement of plunger 25 to its rest position 25', which takes place immediately after insertion of a bag into a supporting member 18, moving bottom 26 returns to its rest position below supporting member 18 and thus prevents those bags 15 which have been introduced into the support members at apparatus 1a from dropping out of the bottom of support member 18. This can also be prevented by designing supporting member 18 as a clamp, for example. For this purpose, the two oppositely disposed walls, or arms, 28 can be pressed somewhat apart by spreaders provided at the plunger (not shown) and can then be permitted to snap back in order to grip bag 15.

The filling and closing of the bags need not necessarily take place at two stations, i.e. in two steps, in that the filling and closing operations could be distributed in a known manner among a plurality of stations. Thus, for example, the bag could be filled almost to its top at one station and in the next station the correct fill level could be attained, while the closing process, involving steps of folding, welding and the like, could also take place at successive stations.

As shown in FIG. 1, apparatuses 1a and 1b are spaced a distance 3t from one another along the conveying direction, t being the spacing between supporting members 18. When the chain stops in order to permit advance and retraction movement of the two shafts 30, two supporting members $\mathbf{18}_1$ and $\mathbf{18}_2$ are present between apparatuses 1a and 1b. In this case supporting member $\mathbf{18}_2$ contains a bag 15 while supporting member $\mathbf{18}_1$ is still empty. This is so because the insertion of a bag 15 is effected only during every second step of the chain of supporting members. After the next two steps, the missing bag is then inserted into supporting member $\mathbf{18}_1$ from apparatus 1*b*. The bags 15 in supporting members 18 are additionally identified by an "*a*" or "*b*", respectively, in a circle, in order to indicate from which one of apparatuses 1*a* and 1*b* they originate.

The above-described system is much more efficient than prior art systems employing a single bag forming apparatus, of the type, for example, disclosed in the above-cited patents, and subsequent filling and closing means. Conventional filling and closing means, as already mentioned above, can easily fill and close many more bags than a single bag forming apparatus can supply. The greater output of the present system is by no means the result only of doubling the number of producing devices but is due substantially to the fact that the bags 15 are each introduced by means of a plunger into the supporting members 18 of a laterally disposed conveying device.

If prior art bag forming apparatuses are employed, the conveying means for the filling and closing devices must be stopped until the grippers have been pushed to the top through the cardboard box provided therein, or through supporting members which take the place of the cardboard boxes, and have then been retracted again toward the bottom. Only when the bag is in a condition to be filled can the conveying means perform the next step.

In the present system, however, the chain of supporting members need be stopped only while plunger 25 performs its back and forth movement, which is very fast due to the small mass of this member. During the time when grippers 12 grip the tube 6 and then pull it downwardly, which, in order to prevent tearing of the packaging foil, cannot be done very fast, the chain of supporting members can continue to effect its transporting movement without interference. In this way the relatively great capacity of the filling and closing means can be much better utilized even if only a single bag forming apparatus is provided. Furthermore, as shown above, use of the plunger 25 makes it possible in a very simple way to employ two or possibly even more bag forming apparatuses 1*a* and 1*b* to supply the single chain of support members leading to the filling and closing means 16 and 17.

The two apparatuses 1a and 1b can also be arranged with a mutual spacing of 4*t* instead of 3*t*. In this case, the plungers 25 of the two apparatuses 1*a* and 1*b* must not move back and forth in unison but in a two-beat rhythm so that again all support members of the chain are alternatingly loaded with the bags 15 produced by these two apparatuses.

In this case the drive means for two plungers 25 are essentially the same as in the first embodiment of the invention according to FIG. 1, the only difference being that they work in phase opposition. The drive means for the two apparatuses 1*a* and *b* are also the same and must be in accordance with the corresponding plungers 25.

It will be understood that the above description of the present invention is susceptible to various modifications, changes and adaptations, and the same are intended to be comprehended within the meaning and range of equivalents of the appended claims.

I claim:

1. In a system including a bag forming apparatus for forming a succession of bags, bag filling and closing means, and a conveying apparatus for conveying each bag, after it is formed, along a conveying path from the bag forming apparatus to the filling and closing means, the conveying apparatus being composed of a plurality of supporting members each serving to support and convey a respective bag from the forming apparatus, the improvement wherein: said bag forming apparatus is disposed laterally to one side of the conveying path defined by said conveying apparatus; said bag forming apparatus comprises a bag transporting member mounted to undergo forward and return movement perpendicular to the conveying direction for inserting each bag, after it has been formed, into a respective supporting member, whereby the conveying apparatus can convey bags which were previously formed while further bags are being formed by said bag forming apparatus; each of said supporting members has a U-shaped cross section in the horizontal plane; said bag transporting member has a horizontal arm defining a bag supporting surface and a vertical arm which give said bag transporting member an L-shaped cross section in a vertical plane transverse to the conveying path; said conveying apparatus comprises means defining a stationary supporting surface extending along the conveying path beneath said supporting members for supporting the bottoms of bags being conveyed by said conveying apparatus, the stationary surface having a gap adjacent said bag transporting member into which gap said horizontal arm moves, during forward movement of said bag transporting member, to come into alignment with said stationary supporting surface; and said conveying apparatus further comprises means defining a movable bag supporting surface movable between a rest position in which said movable supporting surface is disposed in the gap and at the same level as the stationary supporting surface and a retracted position in which said movable supporting surface is spaced from the gap, said movable supporting surface being moved to its retracted position in response to forward movement of said bag transporting member and returning to its rest position during return movement of said bag transporting apparatus.

* * * * *